114-242
9/23/80 OR 4,223,627

United States Patent [19]

Mougin

[11] 4,223,627

[45] Sep. 23, 1980

[54] PROPULSION DEVICE FOR EMBEDDING IN AN ICEBERG

[75] Inventor: Georges L. Mougin, Paris, France

[73] Assignee: ITI Limited, Paris, France

[21] Appl. No.: 899,251

[22] Filed: Apr. 24, 1978

[30] Foreign Application Priority Data

Apr. 22, 1977 [FR] France ..... 77 12178

[51] Int. Cl.[2] ..... B63B 21/56

[52] U.S. Cl. ..... 114/242; 440/49; 440/72

[58] Field of Search ..... 114/270, 242; 115/72; 405/61, 217

[56] References Cited

U.S. PATENT DOCUMENTS 3,931,715 1/1976 Fitch et al. ..... 405/217

OTHER PUBLICATIONS

Cooper, Larry M.; Iceberg Farming: A new Supply of Fresh Water? Mar. 1973, pp. 28–29.

*Primary Examiner*—Trygve M. Blix
*Assistant Examiner*—Jesus D. Sotelo
*Attorney, Agent, or Firm*—George E. Kersey

[57] ABSTRACT

The device comprises an assembly of three principal components, a member for embedding in the rear wall of a tabular iceberg at some depth below the water line, a support structure projecting therefrom and a propulsion unit. It preferably includes a shield to transmit the thrust to a sufficiently large surface of the iceberg wall to avoid creep problems. The propulsion unit may be an electric motor.

9 Claims, 3 Drawing Figures

PROPULSION DEVICE FOR EMBEDDING IN AN ICEBERG

The present invention concerns a propulsion device which can be embedded in the submerged vertical rear wall of a tabular iceberg, and a method of installing a propulsion device in accordance with the invention.

Tabular icebergs originate exclusively in the Antarctic. In the Antarctic the ice does not advance in the form of tunnels, but rather as a plateau which has a well-defined frontier where it meets the sea. The Antarctic continent is not encircled by mountains, but is ringed with a rim of ice, part of which is supported on the continental shelf and the rest of which floats upon the sea. Under the pressure of the ice inland, this mass of ice is slowly pushing towards the sea, and from time to time tabular icebergs become detached from it. These may have very large dimensions, covering several square kilometers. Nevertheless, it is possible to transport these tabular icebergs to dry regions in both hemispheres of the earth situated close to the coast.

Moving a tabular iceberg requires a horizontal force of several hundreds of tons. This may be produced by tugs, the most powerful in service at present being capable of exerting a tractive effort of 120–150 tons. A 30,000 horsepower tanker can produce a tractive effort of 250 tons at a speed of 0.5 meters per second. A vessel of this type, together with two tugs, is required for installing various protective devices around the tabular iceberg in accordance with techniques disclosed elsewhere by the present applicants. Nevertheless, it would seem that there is an advantage in providing additional thrust by means of propulsion devices attached to the tabular iceberg. Such an arrangement is of particular interest insofar as the cost of a propulsion device in accordance with the invention and the installation of the electrical power generation equipment required to drive it may be less than that of using a tug providing the same tractive effort. The ferrying of a tabular iceberg from the Antarctic to the northern hemisphere at a speed of 0.5 meters per second takes several months, and is not a straightforward matter, mainly because of the number of tugs required and the limited periods of autonomy available from tugs, which is generally around one month.

For a rectangular tabular iceberg, the vertical dimension of the submerged portion is from 6 to 8 times greater than that of the portion above sea level, the total thickness of the iceberg being from 250 to 300 meters. Thus it is possible to attach to the submerged vertical rear wall of a tabular iceberg one or more propulsion devices supplied with electrical energy by equipment installed on the upper portion of the tabular iceberg, for example, on its substantially horizontal upper surface. The electrical power generation plant may consist of a petrol or oil-fuelled generator set or a generator using the difference between the temperatures of the water at the surface of the sea in tropical waters and the water produced by melting of the iceberg and collected in a pool formed on the substantially horizontal upper surface of the iceberg in accordance with techniques disclosed elsewhere by the present applicants.

A propulsion device attached to the submerged vertical rear wall of a tabular iceberg must be submerged to a depth of about 40 meters beneath the mean sea level, so as not to be subject to excessive loads due to the movement of the water surface.

The present invention proposes the use of a propulsion device embedded in the submerged vertical rear wall of the tabular iceberg. To this end, the propulsion unit, consisting of an electric motor driving a screw located, if necessary, in a shroud, is maintained at a sufficient distance from the submerged vertical rear wall of a tabular iceberg by a structure including members which are embedded in said rear wall. A shield is located between the structure to which the propulsion unit is attached and the members to be embedded in the iceberg. This shield transmits the thrust generated by the propulsion unit to the iceberg, and has a surface area sufficiently large for the pressure to be less than that producing creep. The members to be embedded in the iceberg consist of tubes whose end faces and whose longitudinal surfaces are provided with independently energized electrical heating resistances. The diameter of these tubes is approximately one meter. The heating resistances are required for embedding the propulsion device and for its recovery where the tabular iceberg has reached the coastal waters of the dry regions in which it will be used by melting the ice to provide fresh water, in accordance with techniques disclosed elsewhere by the present applicants. The structure to which the propulsion unit is attached comprises sealed tubes which may be progressively and independently filled with ballast. These tubes terminate at the shield and are spaced at their other ends by fins which support the electric motor and the screw which is located, if necessary, in the shroud. Fairings, located in front of the electric motor and between the motor and the screw act as buoyancy tanks which compensate for the weight of the motor and screw. If a shroud is used, it is of hollow structure in order that its positive buoyancy shall compensate for the weight of the screw.

It will be seen that a propulsion device in accordance with the invention is so designed that it has buoyancy tanks in its upper portion and ballast in its lower portions so that its center of buoyancy is above its center of gravity, which maintains the propulsion unit horizontal. A device which is known per se is used to regulate the depth to which the propulsion unit is submerged by adding or removing small quantities of ballast on the line joining the centers of buoyancy and gravity, and a reversible and removable low-power side thruster mounted directly above the screw on the support structure to which the propulsion unit is attached maintains the propulsion unit perpendicular to the submerged vertical rear wall of the iceberg (i.e. parallel to the longitudinal axis of the iceberg).

A propulsion device in accordance with the invention is installed as follows: the propulsion unit is submerged to a pre-determined depth and oriented perpendicularly to the submerged vertical rear wall of the iceberg, i.e. parallel to the longitudinal axis of the iceberg, the screw of the propulsion unit exerting a thrust on the vertical rear wall of the tabular iceberg via the heated end-faces of the members which become progressively embedded in the iceberg until the shield comes into contact with the submerged vertical rear wall of the iceberg. The thrust developed by the propulsion unit may be as much as several tens of tons. To recover the propulsion device, the longitudinal surfaces of the embedded elements are heated as the screw is rotated so as to exert a tractive force to pull the device away from the submerged vertical rear wall of the iceberg.

The invention will now be described in more detail, by way of example only, and with reference to the accompanying diagrammatic drawing, in which.

Figure 1:
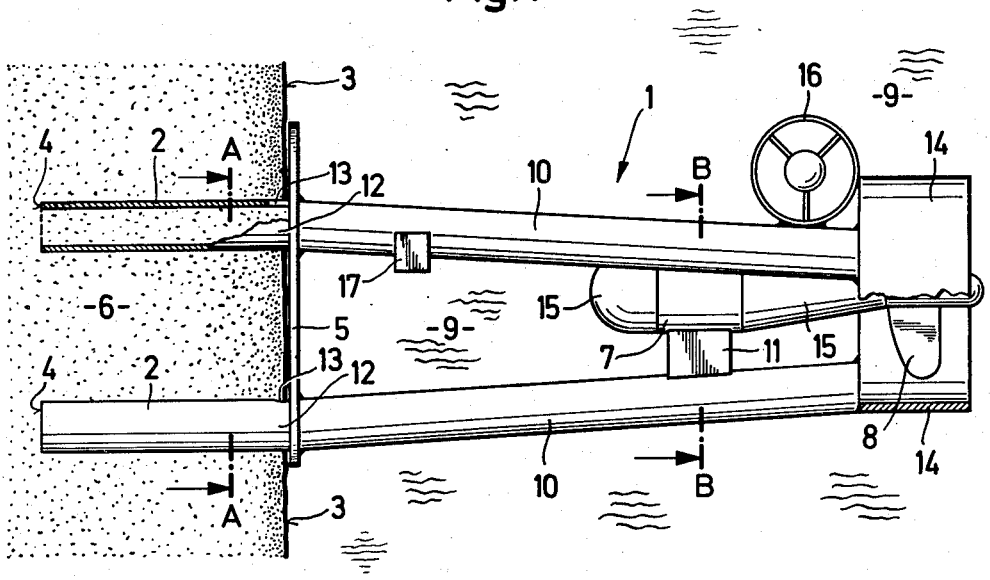
FIG. 1 is a partially cut away side-view of the propulsion device in accordance with the invention embedded in the submerged vertical rear wall of a tabular iceberg.
Figure 2:
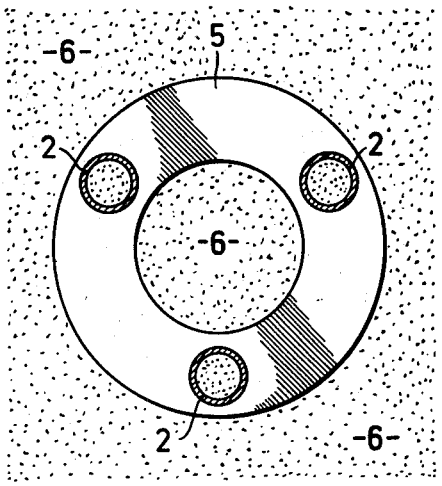
FIG. 2 is a cross-section of the line A—A in FIG. 1.

Referring to FIG. 1, a propulsion device (1) in accordance with the invention is embedded in the vertical rear wall (3) of a tabular iceberg (6) by means of members (2) which consist of tubes with a diameter of approximately one meter and a length of 6 to 8 meters. On the end faces (4) of the members (2) are placed heating resistances which are supplied with power independently of the heating resistances of the horizontal surfaces of the members (2). These heating resistances are not shown in the drawings. At the other end (12) of the members (2) is a shield (5) which bears on the submerged vertical rear wall (3) of the tabular iceberg (6). The surface area of this shield (5) is sufficient for the pressure resulting from the thrust exerted by the propulsion unit (1) to be less than the pressure producing creep of the ice of the tabular iceberg (6). Close to the ends of the tubular elements (2) is an orifice (13) for exhausting the sea water (9) contained in the members (2) as they become embedded in the ice of the tabular iceberg (6).

To shield (5) is attached the structure supporting the propulsion unit, which consists of an electric motor (7) driving a screw (8). The electric motor (7) is preferably of the asynchronous type with an air-gap filled with fresh water maintained at a pressure slightly greater than that of the sea water (9) in which the propulsion unit (1) is immersed and in which the tabular iceberg (6) is floating. The structure supporting the propulsion unit consists of sealed tubes (10) with a diameter of about 1.2 meters and a length of 15 to 20 meters. This is to leave a sufficiently large gap between the screw (8) and the submerged vertical rear wall (3) of the tabular iceberg (6). The sealed tubes (10) form a truncated pyramid with its base at the shield (5) and its summit at fins (11) arranged in star-like formation around the electric motor (7).

Figure 3:
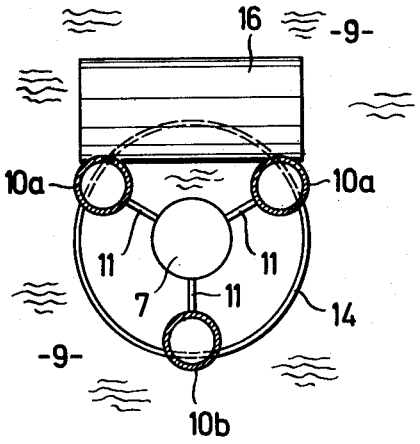
FIG. 3 is a cross-section of the line B—B in FIG. 1.

In the embodiment shown in FIGS. 1 and 3, the members to be embedded in the iceberg consist of 3 parallel tubes (2) and the structure supporting the propulsion unit consists of the three tubes (10). The two upper tubes (10A) of said structure act as buoyancy tanks, and the lower tube (10B) is ballasted. This arrangement is of particular interest in that the buoyancy tanks (10A) are located above the ballast so that the center of gravity is located beneath the center of buoyancy: which keeps the propulsion unit (1) horizontal. The three fins (11) are arranged in star-like configuration around the electric motor (7). The screw (8), which has a diameter of approximately 5 meters is located in a hollow shroud (14) with a diameter of approximately 6 meters. The shroud (14) is connected to the sealed tubes (10). Fairings (15) are located in front of the electric motor (7) and between the electric motor (7) and the screw (8) so as to act as buoyancy tanks for compensating the weight of the electric motor (7) and the screw (8).

As can be seen in FIG. 3, a reversible and removable low-power side thruster is mounted directly above the screw (8) on the upper tubes (10A), which may be progressively and independently filled with ballast by a servo-controlled device (17) which is known per se and which regulates the depth to which the propulsion unit (1) is submerged. The reversible thruster (16) ensures that the propulsion unit (1) is perpendicular to the submerged vertical rear wall (3) of the tabular iceberg (6), for example by means of ultrasonic sensors placed on the submerged vertical rear wall (3) of the iceberg (6) on either side of the propulsion unit (1). When the propulsion unit (1) is embedded in the submerged vertical rear wall (3) of the tabular iceberg (6), the reversible thruster (16) is removed using a known technique.

Each of the propulsion units (1) in accordance with the invention is installed at a depth of approximately 40 meters below the mean level of the sea (9) in which the tabular iceberg (6) is floating. The propulsion unit (1) is submerged to the required depth, and maintained at that depth by the device (17). It is oriented relative to the submerged vertical rear wall (3) of the tabular iceberg (6) by means of the reversible thruster (16). The electric motor (7) is then operated to rotate the screw (8), and at the same time the heating resistances on the end face (4) of the members (2) to be embedded in the iceberg are supplied with electric current. This melts the ice of the tabular iceberg (6) so that the members (2) become progressively embedded therein, under the action of the thrust exerted by the screw (8), and until the shield (5) bears against the submerged vertical rear wall (3) of the tabular iceberg (6). The sea water (9) contained in the embedded members (2) is progressively driven out through the openings (13). When the shield (5) contacts the rear wall of the iceberg the supply of electrical current to the heating resistances on the end face (4) of the members (2) is stopped.

To recover the propulsion device, it is only necessary to heat the side wall of the members (2) and to rotate the screw (8) so as to exert a tractive effort to pull the propulsion unit (1) away from the submerged vertical rear wall (3) of the tabular iceberg (6).

It should be noted that the propulsion unit is connected to the substantially horizontal upper surface of the tabular iceberg (6) by safety cables and electric power and control cables which are not shown in the drawings. Furthermore, the use of buoyancy tanks distributed along the whole length of the propulsion unit (1) prevents the generation of an embedding moment which could produce creep in the ice of the tabular iceberg (6) around the embedded members (2).

I claim:

1. A propulsion device for an iceberg comprising a propulsion mechanism;

means for submerging the propulsion mechanism to a prescribed depth in the vicinity of the iceberg, and means for attaching the submerged propulsion mechanism to the iceberg at a prescribed position below the water line thereof, said propulsion mechanism having a support structure which includes sealed tubes which can be progressively and independently filled with ballast.

2. A device according to claim 1, wherein the sealed tubes of the propulsion mechanism support structure terminate at a shield and are spaced at their other ends by fins which support the propulsion mechanism, which consists of an electric motor driving a screw.

3. A device according to claim 2, including fairings in front of the electric motor and between the motor and the screw, which fairings act as buoyancy tanks.

4. A device according to claim 2, including a hollow shroud enclosing the screw and acting as a buoyancy tank.

5. A device according to claim 1, including:

buoyancy tanks in its upper portions and ballast in its lower portions so that its center of buoyancy is above its center of gravity;

a device for adding and removing small quantities of ballast on the line joining the centers of buoyancy and gravity; and a reversible and removable low-power side thruster mounted directly above the screw on the support structure.

6. A propulsion device according to claim 1 including a shield between said propulsion mechanism and the attaching means, said shield serving to transmit the thrust generated by said propulsion mechanism to the iceberg below the waterline thereof.

7. A device according to claim 1 wherein the attaching means comprises tubes having ends which are independently heated by electrical heating resistances.

8. A method of installing a device for propelling an iceberg comprising the steps of (a) submerging a propulsion unit to a predetermined depth, (b) orienting said propulsion unit with respect to a submerged wall of the iceberg, (c) heating an end of said propulsion unit while applying a thrust thereto to embed said end in the iceberg.

9. The method of removing the propulsion unit of claim 5 wherein the embedded end is heated as said propulsion unit is counteroperated to exert a tractive force to pull said unit away from said wall.

* * * * *